US008115120B2

(12) United States Patent
Villain et al.

(10) Patent No.: US 8,115,120 B2
(45) Date of Patent: Feb. 14, 2012

(54) ELECTRICAL SWITCH WITH MULTIPLE SWITCHING CHANNELS

(75) Inventors: Jean-Christophe Villain, Dole (FR); Michel Cour, Sampans (FR)

(73) Assignee: CoActive Technologies, LLC, Newton, MA (US)

( * ) Notice: Subject to any disclaimer, the term of this patent is extended or adjusted under 35 U.S.C. 154(b) by 625 days.

(21) Appl. No.: 12/179,372

(22) Filed: Jul. 24, 2008

(65) Prior Publication Data

US 2009/0095611 A1 Apr. 16, 2009

(30) Foreign Application Priority Data

Jul. 24, 2007 (FR) ..... 07 56695

(51) Int. Cl.
*H01H 29/16* (2006.01)

(52) U.S. Cl. ..... 200/6 A

(58) Field of Classification Search ..... 200/6 A, 200/9, 339, 6 R
See application file for complete search history.

(56) References Cited

U.S. PATENT DOCUMENTS

| | | | | |
|---|---|---|---|---|
| 2,808,476 | A * | 10/1957 | Elliott | 200/6 A |
| 5,621,196 | A * | 4/1997 | Nishijima et al. | 200/6 A |
| 6,593,909 | B1 * | 7/2003 | Chou | 200/6 A |
| 6,809,274 | B2 * | 10/2004 | Takeuchi et al. | 200/6 A |
| 6,897,391 | B2 * | 5/2005 | Gavalda | 200/512 |
| 7,282,656 | B2 * | 10/2007 | Niiyama | 200/6 A |

FOREIGN PATENT DOCUMENTS

| | | |
|---|---|---|
| EP | 1037230 A | 9/2000 |
| JP | 2000200141 A | 7/2000 |

* cited by examiner

*Primary Examiner* — Felix O Figueroa
(74) *Attorney, Agent, or Firm* — Pepper Hamilton LLP

(57) ABSTRACT

An electrical switch with multiple switching channels may include a frame, a panel with which a pointing element comes into contact. The electrical switch may have a location element which locates the point of contact of the pointing element on the panel which may include a plurality of switching elements. The electrical switch may have a detection element which detects at least one control action independent of the position of the point of contact with the panel. The electrical switch may have an intermediate plate on which the panel acts in order to cause the change in state of the switching elements. The intermediate plate may be configured to cause the change in state of switching elements and detection element. The plate can be at least in part deformed in order to actuate the detection element after changing the state of the switching elements.

15 Claims, 3 Drawing Sheets

ELECTRICAL SWITCH WITH MULTIPLE SWITCHING CHANNELS

RELATED APPLICATIONS AND CLAIM OF PRIORITY

This patent application claims priority to French Application No. 0756695, filed Jul. 24, 2007, the disclosure of which is incorporated herein by reference in its entirety.

BACKGROUND

The recent developments and rapid evolution of telecommunications, for which the control of diverse functions anticipates, for example, moving a cursor precisely and quickly on a screen, makes it necessary to have electromechanical components of increasingly small size and to combine several electrical switching functions within a single component.

It may be desirable to have an electrical switch with multiple switching channels using a single actuating member that can be operated with one finger. Such operations, for example by using the lower face of the thumb of the user who is holding the device in his palm, may be easy and able to be carried out in as many directions as possible, with very good ergonomics and low operating forces (less than 2 newtons).

In addition, such a miniaturized component may provide its user with a tactile sensation reflecting the validity of operations carried out. The tactile sensation transmitted by the switch to the user may be a very important parameter for its performance and ergonomics.

The document filed under Application FR 06/51319 describes a switch of this type, the upper face of its upper panel being divided into several contact areas with each of which the pointing element is able to come into contact, and electrical switching elements associated with the contact areas and the state of which changes when the pointing element comes into contact with the associated contact area.

The switch also includes an element enabling a tactile sensation to be produced that is similar to a "click" of a conventional push-button in returning from a control action carried out by the user on the switch.

According to that document, the switch includes an intermediate plate to cause the change in state of the switching elements which is mounted so as to move relative to the upper panel and relative to the support frame in order to enable a distinct change in state of the switches and of the element producing the tactile sensation.

However, according to that document, the difference in amplitudes between a control action applied to the center of the upper panel and a control action applied to the periphery of the upper panel is relatively large, which may disturb the user who is acting on the switch. In addition, the movements of the upper panel and the plate relative to each other, and relative to the frame, entail a large vertical stroke of the upper panel, which runs counter to a concern for miniaturization.

SUMMARY

An electrical switch may control an electronic device with several switching channels divided around a main vertical axis of the actuator.

In an embodiment, an electrical switch with multiple switching channels may include a support frame. The support frame may be a lower horizontal support frame. The electrical switch may include a panel. The panel may be a an upper horizontal panel. The panel may be mounted in a mobile manner relative to the frame and a face with which a pointing element is configured to come into contact. In an embodiment, the panel may be mounted in a vertically mobile manner relative to the frame. In an embodiment, the face may be an upper horizontal face. The electrical switch may include a location element for locating the point of contact of the pointing element on the face of the panel, including a plurality of electrical switching elements, each of which is associated with a switching channel, which are configured to change state selectively, depending on the position of the point of contact, when the pointing element comes into contact with the face of the panel.

In an embodiment, the electrical switch may include a detection element which detects at least one control action which are configured to establish an associated switching channel when a pressing force with a value greater than or equal to a threshold value is exerted on the face of the panel by the pointing element. The establishment of the switching channel may be independent of the position of the point of contact with the face of the panel.

In an embodiment, the electrical switch may include an intermediate plate that may be arranged vertically between the upper panel and the frame, and on which the upper panel may act in order to cause the change in state of the switching elements.

In an embodiment, an electrical switch as previously described, may include an intermediate plate that is configured to cause the change in state of the switching elements and is configured to act on the detection element under the action of the panel, and in that the plate is at least partly deformable in order to actuate the detection element which detects the control action after changing the state of the switching elements.

In an embodiment, the detection element may be arranged at the center of the panel. In an embodiment, the detection element may be arranged horizontally at the center of the upper panel. The switching elements may be distributed around the detection element.

In an embodiment, the intermediate plate may include a central portion for actuating the detection element and may include portions extending radially outwards from this central portion. The outer radial end of each radial portion may be configured to cause the change in state of a switching element which is associated with the radial portion. The intermediate plate may be configured to deform such that each radial portion is configured to rock entirely about its inner radial end connecting it with the central portion of the intermediate plate in order to change the state of the associated switching element, and such that each radial portion is configured to rock about its outer radial end to actuate the detection element.

In an embodiment, the outer radial end of each radial portion may include a boss which may project downwards relative to the radial portion, and which may be configured cooperate with the associated switching element. The boss may be configured to press downwards on the frame such that the radial portion rocks about the boss to actuate the detection element.

In an embodiment, the panel may include a plurality of lower fingers, each of which is associated with a radial portion of the intermediate plate, which extends from a face of the panel, with the lower free end of the finger being configured to press downwards on the associated radial portion. In an embodiment, the plurality of lower fingers, may extend vertically downwards from a lower face of the upper panel. Each lower finger may be positioned radially such that it presses on the associated radial portion at a point of contact situated radially between the outer radial end and the inner radial end of the connection.

In an embodiment, the intermediate plate may be made in one piece by cutting and bending an elastically deformable metal plate. The central portion of the intermediate plate may include a pusher made of an elastically deformable material, which is connected to the inner ends of the radial portions.

In an embodiment, the detection element may include a single element forming a releasable stop for the central portion of the intermediate plate, in moving downwards, and which may be configured to change state when the control action is carried out on the panel. The switch may include an elastic element for returning the panel to a rest position. In an embodiment, the panel may be an upper panel. In an embodiment, the rest position may be a high first position. Each switching element may include two electrical contacts which may be carried by the frame and which may be configured to be electrically connected by an associated metal tongue under the action of the panel.

In an embodiment, the metal tongue maybe elastically deformable in order to connect to the electrical contacts. All the metal tongues may be part of a single metal piece including a central ring connected to an electrical contact common to all the switches. The outer radial end of each radial portion of the intermediate plate may be configured to press on an associated tongue in order to actuate the switch. In an embodiment, the intermediation place may press downwards. An intermediate protection film may be arranged between the intermediate plate and the metal piece. In an embodiment, the intermediate protection film may be vertically arranged.

BRIEF DESCRIPTION OF THE DRAWINGS

Aspects, features, benefits and advantages of the embodiments described herein will be apparent with regard to the following description, appended claims, and accompanying drawings where:

DETAILED DESCRIPTION

Figure 1:
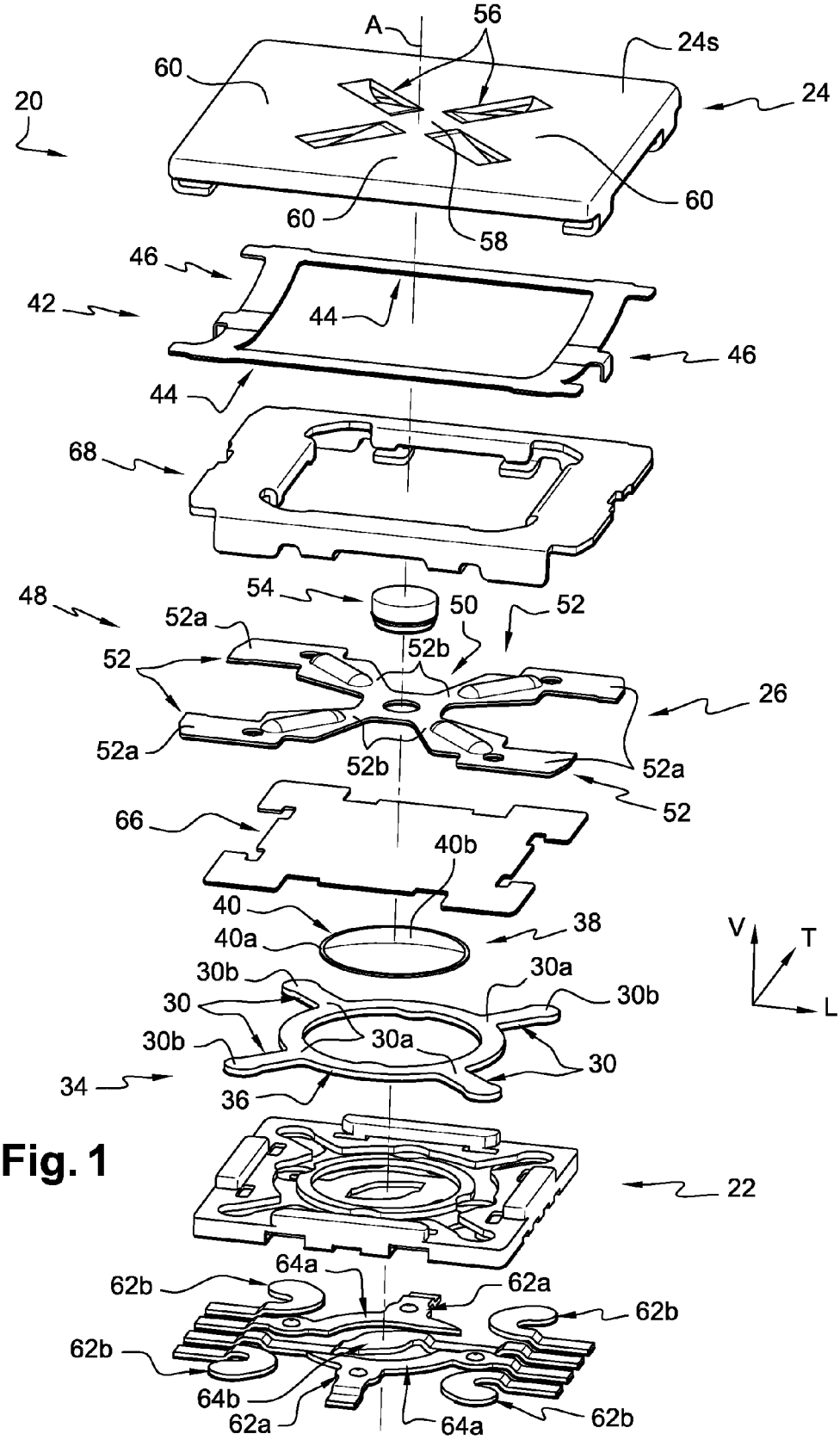
FIG. 1 is a schematic exploded perspective representation of a switch according to an embodiment.

As used herein and in FIG. 1, the use of the term vertical, longitudinal and transverse as directions (V, L, and T respectively) are non-limiting and the device and elements of the device may be depicted in any configuration. In an embodiment, the vertical direction V corresponds in an arbitrary manner to the orientation of FIG. 1 and without any reference to the Earth's gravity.

In FIG. 1, an electrical switch 20 may be represented which is intended to control the various functions of an electronic device such as, for example, a portable telephone or a computer.

The switch 20 may include a vertical stack including a lower support frame 22 and an upper panel 24 which may be mounted so as to move overall vertically relative to the frame 22.

According to the embodiment represented in particular in FIG. 1, the switch 20 may be in the form of, but not limited to, a parallelepiped, such as, a horizontal square, having a vertical main axis of symmetry A. In an embodiment, the switch 20 may be in the general shape of a circular cylinder.

In order to control the functions of the electronic device on which the switch 20 is mounted, the user may use a pointing element (not shown) such as, but not limited to, a stylus or a finger, to bring the pointing element into contact with the upper horizontal face 24*s* of the upper panel 24.

The switch 20 may include an element 26 for determining the position of the point of contact of the pointing element on the upper face 24*s* of the upper panel 24. The element 26 may include a plurality of electrical switching elements 28, such as, but not limited to, four, on which the upper panel 24 may be configured to act in a selective manner, depending on the position of the point of application of the pointing element, in order to cause the change in state of the switching elements 28.

When a switching element 28 changes state, the switching element 28 may close an electrical circuit associated with it by establishing a switching channel of the switch 20, enabling the flow of an electric current in this circuit through to an electronic control device (not shown) for the electronic apparatus, in order to cause a predefined action, such as, for example, the movement of a cursor on a display screen in a direction associated with the position of the point of contact of the pointing element with the upper face 24*s* of the upper panel 24.

The switching elements 28 may be configured to be actuated in a selective manner by the upper panel 24 under the action of the pointing element and depending on the position of the pointing element on the upper face 24*s* of the upper panel 24.

As mentioned further above, the switch 20 may be, but is not limited to, the overall form of a horizontal square. In an embodiment, the switching elements 28 may be preferably located at the corners of the square. In an embodiment, there may be four switching elements 28. The switching elements 28 may be arranged in such a way that when the pointing element is pressed on the upper panel 24 at a lateral edge of the upper panel 24 two adjacent switching elements 28 may be actuated simultaneously or almost simultaneously. When the pointing element is pressed on the upper panel 24 at the center of the upper panel at least two switching elements 28 that are radially opposite relative to the vertical axis A of the switch 20 may be actuated.

Each switching element 28 may include two electrical contacts 62*a*, 62*b* which may be mounted on the frame 22 and which may be configured to be electrically connected by a metal tongue 30 of the switching element 28 under the action of the upper panel 24.

Each metal tongue 30 may be made of an electrically conductive material. The metal tongue 30 may include a first end 30*a* which ma be connected in a permanent manner to a first electrical contact 62*a*, and a second free end 30*b* which may be situated at a distance from the second electrical contact 62*b*.

The metal tongue 30 may be configured to be elastically deformed under the action of the upper panel 24 in such a way that its second end 30*b* may come into contact with the second electrical contact 62*b* in order to establish the associated switching channel.

Each switching element 28 may be of the normally open type. The metal tongues 30 of all the switching elements 28 may be made by cutting and bending from a single horizontal metal piece 34, which simplifies the production of the switch 20.

In an embodiment, the first end 30*a* of each metal tongue 30 may be connected to a central metal ring 36 of the metal piece 34, which may be centered on the main vertical axis A of the switch 20 and which may be in permanent contact with a common electrical contact 62*a*, which may constitute the first electrical contact of each switching element 28.

The switch 20 may include a detection element 38 to detect an additional control action by applying a pressing force to the upper face 24*s* of the upper panel 24, the value of which may be greater than a threshold value, independently of the position of the point of contact of the pointing element on the upper face 24*s* of the upper panel 24.

When carrying out the control action, the user may not be obliged to move the pointing element relative to the upper panel 24. It may be possible to make use of a function of the electronic device which is directly linked to the position of the point of contact of the pointing element.

The detection element 38 which detects the control action may include an electrical switch which may be configured to establish another additional switching channel of the switch 20.

This switch may be arranged on the frame 22 at the center of the switch 20 and it may include an elastically deformable element 40 which may be in the form of a dome that is coaxial with the main vertical axis A, domed upwards, and two electrical contacts 64*a*, 64*b* which may be configured to be connected by the deformable dome 40 when the user carries out the control action.

To do this, the circular peripheral edge 40*a* of the deformable dome 40 may be in permanent contact with a first electrical contact 64*a* and the central apex 40*b* may be situated vertically above and at a distance from the second electrical contact 64*b*.

Hence, when the user carries out the control action, the apex 40*b* of the deformable dome 40 may move vertically downwards to come into contact with the second electrical contact 64*b* in order to connect it electrically with the first electrical contact 64*a*.

The switch 20 may produce a single mechanical pulse on the upper panel 24 on return from the user's action by the pointing element and independently of the number of switching elements 28 that may be actuated by the upper panel 24. This pulse may be transmitted by the upper panel 24 through to the pointing element to be felt by the user.

No matter what the position of the point of contact of the pointing element on the upper panel 24, and no matter what the number of switching elements 28, the user may feel a single mechanical pulse on return from the control action, in the same way he feels a pulse when pressing a conventional push-button.

As seen in the figures, producing the single pulse may include the deformable dome 40, which may form a releasable or retractable stop for the upper panel 24 in a vertical position, which may be configured to change state when the value of the pressing force exerted by the pointing element on the upper face 24*s* of the upper panel 24 is greater than a threshold value.

While changing state, the deformable dome may 40 no longer form a stop for the upper panel 24, which can then suddenly move downwards. During this sudden movement of the upper panel 24, the user may feel a non-continuous variation in the resistance to movement of the upper panel 24, which is interpreted by the user as a tactile sensation. The upper panel 24 may be mounted in a globally vertically mobile manner relative to the support frame 22, in such a way that it may be configured to be moved downwards under the action of the pointing element.

Figure 2:
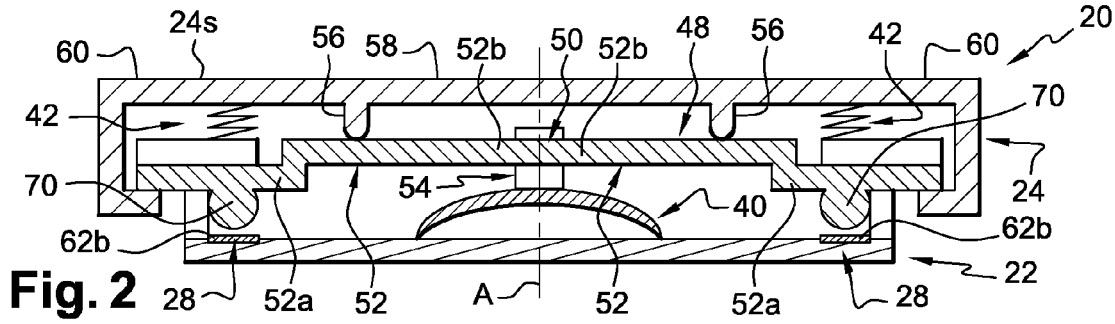
FIGS. 2 to 6 are sections along a vertical plane of the switch represented in FIG. 1, showing various actuation positions of the upper panel according to an embodiment.
Figure 7:
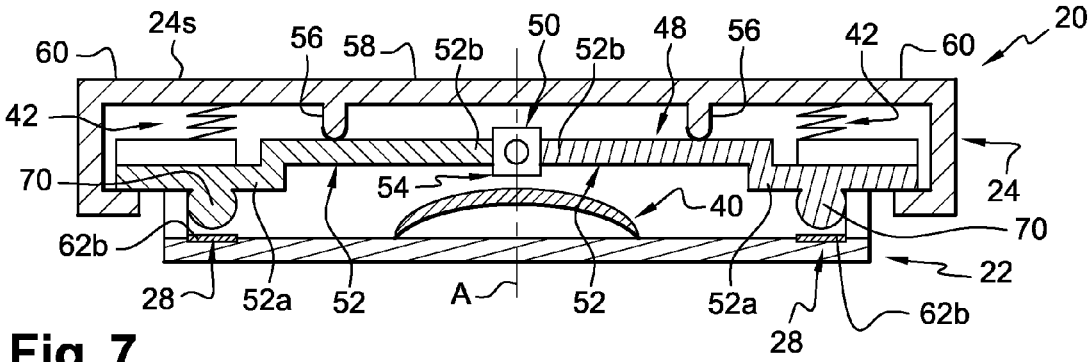
FIGS. 7 to 9 are sections similar to those of FIGS. 2 to 4, showing various actuation positions of a switch according to other embodiments.

The switch 20 may return the upper panel to a high position relative to the frame 22, represented in FIGS. 2 and 7, when the user releases his action on the upper panel 24. In an embodiment, the force for returning the upper panel 24 to its higher position may be exerted by an elastic element 42 which is compressed vertically between the upper panel 24 and the plate 22. The elastic element 42 may include two upper longitudinal arms 44 which may be in contact with a lower face of the upper panel 24 and two transverse arms 46 which may connect the longitudinal arms 44 to each other.

The transverse arms 46 may be vertically curved, their concavity being directed upwards in such a way that the transverse ends of each transverse arm 46, which is connected to a longitudinal arm, may be situated vertically at a distance from the frame and a central portion of each transverse arm 46 may be in contact with the frame 22.

When the upper panel 24 moves downwards, the longitudinal arms 44 may move downwards, causing the elastic deformation of the transverse arms 46.

As mentioned above, when the pointing element acts on the upper panel 24, the switching elements 28 may change state selectively and the detection element 38 may be actuated when the user carries out the action called the control action.

The switch 20 may include an intermediate plate 48 which may be configured to cause the change in state of the switching elements 28 under the action of the upper panel 24, and which may enable the change in state of all the switching elements 28 or only of certain switching elements 28 depending on the position of the point of contact of the pointing element, and which may allow the same switching elements 28 to be kept in this state when the user is carrying out the control action, without causing the change in state of the other switching elements 28.

The plate 48 may be arranged vertically between the upper panel 24 and the frame 22, and it may be produced in such a way that the upper panel 24 actuates the switching elements 28 by the plate 48. The plate 48 may include a central portion 50 centered on the main vertical axis A and a radial portion 52 associated with each switching element 28, which may extend radially relative to the vertical axis A from the central portion 50 and with the free radial end 52*a* of each radial portion 52 being configured to act on the associated switching element 28.

In an embodiment, the plate 48 may be produced in such a way that it may be configured to actuate the detection element 38 to detect the control action under the action of the upper panel 24.

As mentioned above, the plate 48 may include a central portion 50 which may be centered on the main vertical axis A of the switch 20. In an embodiment, the plate 48 actuates the detection element 38 by its central portion 50 which may press downwards on the central apex 40*b* of the deformable dome 40.

In order to concentrate the pressing force on the apex 40*b* of the deformable dome 40, the central portion 50 of the plate 48 may bear a cylindrical pusher 54 that may be coaxial with the deformable element and the horizontal cross section of which may be reduced relative to the cross section of the central portion 50 of the plate 48. The deformable dome 40 may constitute a stop that is releasable by moving the central portion 50 of the plate 48 downwards. According to an embodiment, the plate 48 may be configured to deform in order to actuate the detection element 38 after the change in state of the switching elements 28.

In FIGS. 2-9, in order to act on the plate 48, with a view to causing the change in state of the switching elements 28 and/or of the detection element 38, the upper panel 24 may include a lower finger 56 associated with each radial portion 52 which may extend vertically downwards and which may be configured to press the associated radial portion 52 downwards at a point of contact situated between the outer end 52*a* and the inner end 52*b* of the radial portion 52.

When the pointing element presses on the upper face 24*s* of the upper panel 24, the upper panel 24 may move downwards relative to the frame 22 and at least one finger 56 may press on the associated radial portion 52 with a view to causing the change in state of at least one switching element 28, depending on the position of the point of contact of the pointing element on the upper face 24*s* of the upper panel 24.

As discussed above, the central portion 50 of the plate 48 may stop downwards on the deformable dome 40.

Figure 3:
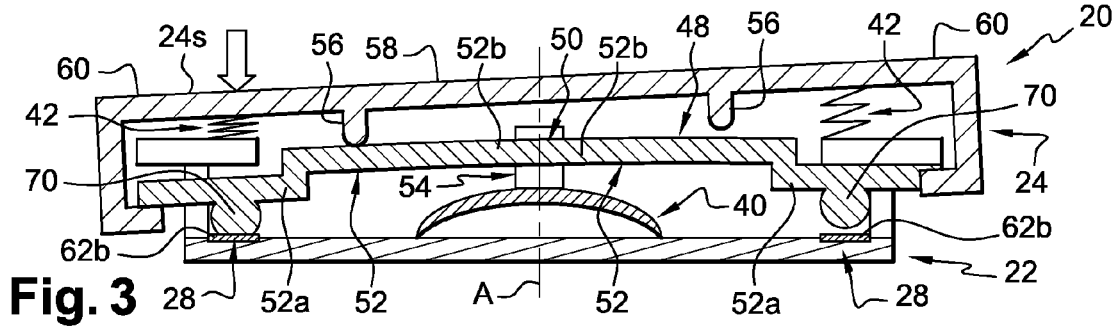
Figure 5:
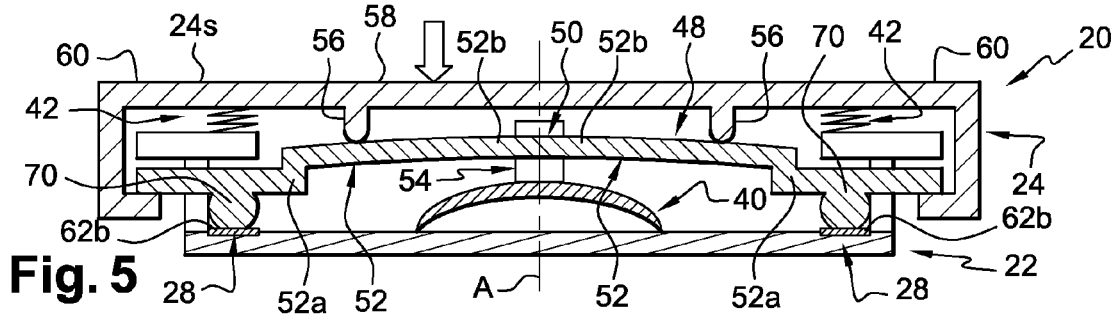

As can be seen in FIGS. 3 and 5, a pressing of the finger 56 on the radial portion 52 may cause the rocking of the radial portion 52 relative to the central portion 50 about its inner end 52*b*, which may not move downwards due to the stop position of the central portion 50. The radial portion 52 may rock downwards until its outer end 52*a* is in a downwards stop position on the frame 22.

In this stop position, the outer end 52*a* of the radial portion 52 may press downwards on the free end 30*b* of the associated metal tongue 30 in order to cause the change in state of the associated switching element 28 by closing it.

Figure 4:
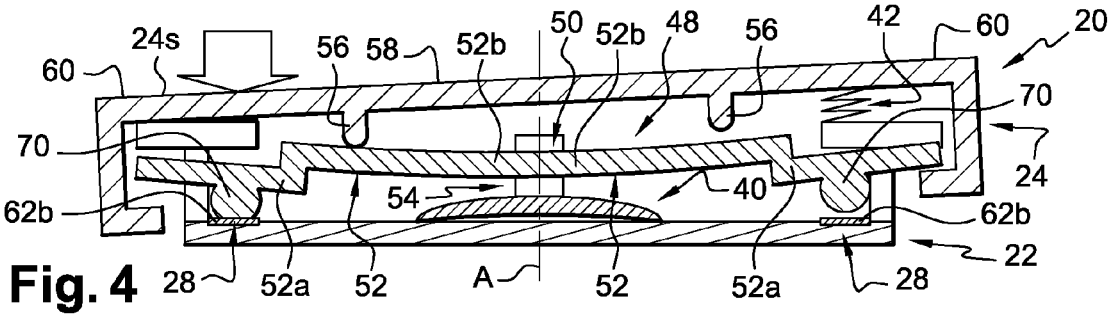
Figure 6:
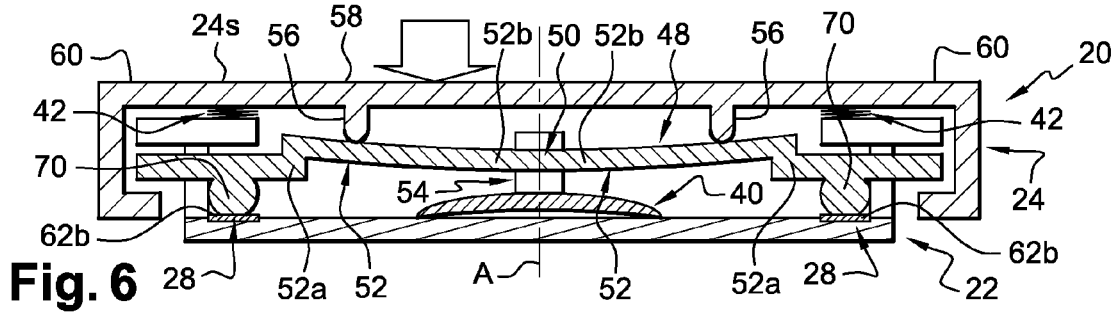

As shown in FIGS. 4 and 6, when the user increases the pressing force of the pointing element on the upper panel 24, in order to carry out the control action, the force may be transmitted to the radial portion 52 by the finger 56. The force may be transmitted to the deformable dome 40, by the central portion 50 of the plate, and may cause a change in state of the deformable element when the value of the force exerted by the user reaches a maximum resistance value of the deformable dome 40.

The deformable dome 40 may deform, allowing a downward movement of the central portion 50 and of the inner end 52*b* of the radial portion 52, and the radial portion 52 may rock downwards about its outer end 52*a*. The change in state of the deformable dome 40 has the consequence of actuating the detection element 38, as well as a sudden downwards movement of the upper panel, which may be felt by the user as a tactile sensation.

According to an aspect of the plate 48, as can be seen in FIG. 2 and following, the outer radial end 52*a* of each radial portion 52 may include a boss 70 which may project downwards relative to the radial portion 52. The radial portion 52 may push downwards on the associated tongue 30 by the boss 70, when the switching element 28 is actuated, and it may rock about the boss 70 when the detection element 38 is actuated.

The position of the point of contact of the finger 56 on the radial portion 52, between its two ends 52*a* and 52*b*, along with the releasable stop of the central portion 50 of the plate formed by the deformable dome 40, may cause a rocking of the associated radial portion 52 about each of the radial ends 52*a*, 52*b*, according to the action the user carries out on the upper panel 24.

The distribution of the fingers 56 relative to the upper panel 24 may be determined so as to divide the upper face 24*s* of the upper panel 24 into several contact areas 58 and 60.

For example, referring to FIGS. 2-9, the upper panel 24 may have two fingers 56 distributed on both sides of the main vertical axis A and which may divide the upper face 24*s* of the upper panel into three contact areas, namely a central contact area 58 situated entirely between the two fingers 56, and two outer contact areas 60, each of which extends radially outwards from a finger 56.

The switch 20 may include a film 66 protecting the electrical contacts which may cover the metal piece 34 and the deformable dome 40 and which may be arranged vertically below the plate 48. The protection film 66 may prevent various polluting elements such as, but not limited to, dust or moisture entering the switch 20 at the level of the electrical contacts 62*a*, 62*b*, 64*a*, 64*b* and the tongues 30, which might impair proper operation of the switch 20. The switch 20 may include an upper cage 68 enabling the components of the switch 20 to be joined to each other.

The operation of the switch 20 may be described with reference to FIGS. 2 to 6, which are axial sections through a switch 20, which may include two switching elements 28 arranged on both sides of the main vertical axis A, and the detection element centered on the main vertical axis A. In addition, according to an embodiment, the plate 48 may be made of a single elastically deformable piece.

In FIG. 2, the switch 20 may be in the rest position, which is to say that no pointing element may be in contact with the upper face 24*s* of the upper panel 24. The upper panel 24 may be in a high rest position relative to the frame, a position in which it may be kept by the elastic element 42. The switching elements 28 and the detection element 38 may be in a rest position for which the switching channels associated with them are not established.

When the input device comes into contact with the upper face 24*s* of the upper panel 24 in an outer contact area 60, as represented in FIG. 3, it may cause downward rocking of the upper panel 24 relative to the frame 22 about a pivot point situated at an edge of the upper panel, opposite the point of contact relative to the main vertical axis A.

The fingers 56 then may move downwards and the finger 56 that is closest to the point of contact of the pointing element on the outer contact area 60 then may come into contact with the plate 48, at a radial portion 52, and the finger 56 may press this radial portion 52 downwards. In an embodiment, the plate 48 may deform in such a way that the radial portion 52 on which the finger 56 may press downwards about its inner radial end 52*b* connecting it to the central portion 50 of the plate 48.

The outer radial end 52*a* of the radial portion 52 may press on the associated tongue 30 (not represented in FIGS. 2-9) by the boss 70 in order to cause the change in state of the associated switching element 28.

The switching channel associated with the switching element 28 that has just changed state may be established, such that the electronic control device connected to the switch may receive a piece of information according to which the pointing element is in contact with the previously defined outer contact area 60.

To carry out the control action, the user may increase the amplitude of the pressure force on the outer contact area 60, as represented in FIG. 4, consequently causing an additional downward movement of the upper panel 24 and of the finger 56.

The greater pressure of the pointing element on the upper panel 24 may be transmitted to the plate 48, and more precisely to the radial portion 52 that has been moved downwards to cause the change in state of the switching element 28. When a switching element 28 has changed state, the boss of the associated radial portion 52 may be stopped against the base of the frame 22.

An additional force exerted by the finger 56 on the radial portion 52 may cause a rocking of the radial portion 52 downwards about its outer end 52*a*, such that the inner end 52*b* of the radial portion 52 may move downwards. The central portion 50 of the plate 48 may be driven downwards, while joined to the inner end 52*b* of the radial portion 52, in order to cause the change in state of the deformable dome 40 of the detection element 38.

In an embodiment, the plate 48 may deform at the inner end 52*b* of the radial portion 52, enabling a downwards movement of the central portion 50 without carrying along the outer ends 52*a* of the other radial portions 52, so as not to cause the change in state of the other switching elements 28 when the detection element 38 is actuated.

When the input device comes into contact with the upper face 24*s* of the upper panel 24 at the central contact area 58, as shown in FIG. 5, the force may be distributed over the upper panel 24, relative to the elastic return element, such that the upper panel 24 slides vertically downwards relative to the frame 22.

The two fingers 56 then may move downwards in one and the same movement, such that they both come into contact with the plate 48, on the radial portions 52.

According to an embodiment, the plate 48 may deform in such a way that the two radial portions 52 rock downwards relative to the central portion 50 about their inner radial ends 52*b*. The central portion 50 may remain vertically immobile and may not therefore actuate the detection element 38.

The outer radial end 52*a* of the radial portions 52 may cooperate with the tongues 30 to cause the change in state of the switching elements 28. The switching channels associated with the switching elements 28 that have just changed state are established, such that the electronic control device connected to the switch 20 may receive a piece of information according to which the pointing element is in contact with the central contact area 58.

To carry out the control action, the user may increase the amplitude of the pressure force on the central contact area 58, as represented in FIG. 6, consequently causing an additional downward movement of the upper panel 24 and of the fingers 56. The greater pressure of the pointing element on the upper panel 24 may be transmitted to the plate 48, and more precisely to the radial portions 52. As previously mentioned, when it causes the change in state of the associated switching element 28, the outer end 52*a* of each radial portion 52 may be stopped against the base of the frame 22.

An additional force exerted by a finger 56 on a radial portion 52 may cause a rocking of the radial portion 52 downwards about its outer end 52*a*, such that the inner end 52*b* of the radial portion 52 may move downwards. The central portion 50 of the plate 48 may be driven downwards, while joined to the inner end 52*b* of the radial portions 52, in order to cause the change in state of the deformable dome 40 of the detection element 38.

According to an embodiment, the plate 48 may deform at the inner end 52*b* of the radial portion 52, enabling a downwards movement of the central portion 50. As mentioned above, the plate 48 may be made of a single piece and may be elastically deformable. During its first deformation, in order to cause the change in state of one or more switching elements 28, the plate 48 may deform such that the central portion 50 becomes convex, domed upwards, as can be seen in FIGS. 3 and 5, and when the plate 48 deforms to cause the change in state of the detection element 38, the central portion 50 becomes concave, open upwards, as can be seen in FIGS. 4 and 6.

Conversely, when the switch 20 is in the rest position, the plate 48, and consequently the central portion 50, may be entirely planar and horizontal.

Figure 8:
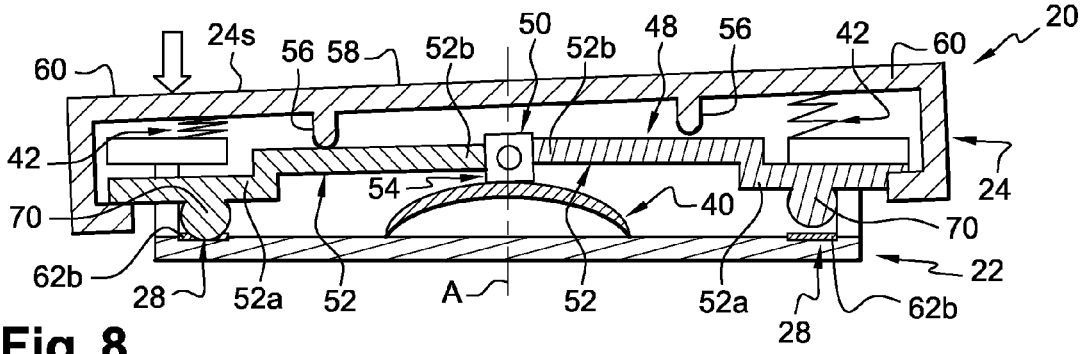
Figure 9:
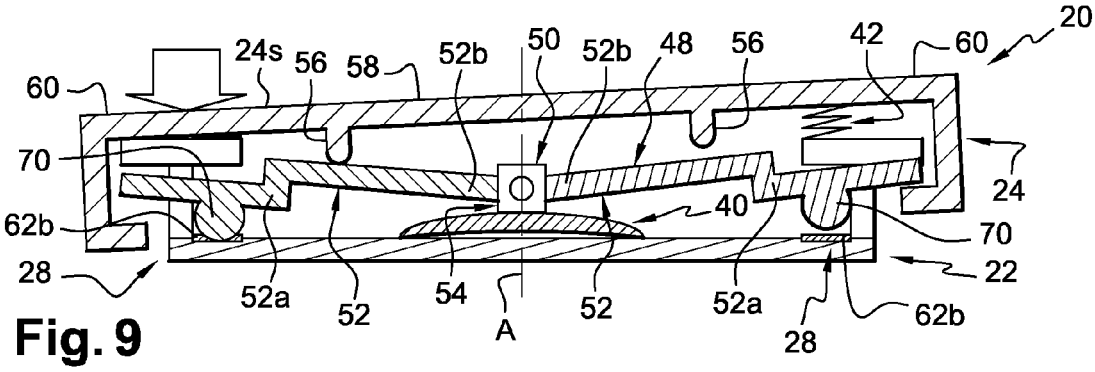

FIGS. 7 to 9 represent another embodiment of the switch 20 to which the plate 48 may be made of several pieces attached to each other. The radial portions 52 are similar components, for example, made of cut and crimped sheet metal, and may be connected to the central portion 50, which may be elastically deformable.

For example, the central portion 50 may be made by over molding plastic around the inner ends 52*b* of the radial portions. According to a variant, the pusher 54 may be produced from the same material as the central portion 50 by molding.

In FIG. 8, when the pointing element comes into contact with the upper face 24*s* of the upper panel 24, the central portion 50 may deform to allow a downward rocking of a radial portion 52 about its inner end 52*b*, until the outer end 52*a* of the radial portion 52 stops downwards against the frame 22, causing the change in state of the associated switching element 28.

The radial position of each finger 56, relative to the main vertical axis A and relative to the associated radial portion 52, and the radial length of the radial portion 52 may be determined such that the value of the pressing force to be applied to the upper panel 24 in order to change the state of the deformable dome 40 may varies moderately depending on the radial position of the point of contact of the pointing element on the upper face 24*s* of the upper panel 24.

When a finger presses on the associated radial portion 52 to cause the downward rocking of the radial portion about its outer end 52*a*, the force transmitted to the deformable dome 40 at the inner end 52*b* of the radial portion may be reduced due to the lever arm about the outer end 52*a* of the radial portion.

The radial portions 52 are preferably identical, and the fingers 56 may be arranged on the same radial side relative to the main vertical axis A of the switch 20. When the control action is transmitted to the plate 48 by several fingers 56, the radial portions 52 concerned may behave like a single force transmitter causing a reduction in the amplitude of the force identical to the reduction obtained by a single radial portion 52.

When the control action is carried out on the central contact area 58, the upper panel 24 may slide downwards relative to the frame 22. The control action may be transmitted to the plate without being reduced in its amplitude. The amplitude of the control action that is transmitted to the deformable dome 40 may be reduced due to the force transmitted by the radial portions 52 that has just been described.

Conversely, when the control action is carried out on an outer contact area 60, as mentioned above, the upper panel 24 may rock relative to the frame 22 about a pivot point opposite the point of contact of the pointing element on the upper panel 24, relative to the main vertical axis A. The upper panel 24 may act as a lever arm transmitting the control action to the plate 48 at a finger 56 or adjacent fingers 56 which are the closest to the point of application of the control action.

The amplitude of the force transmitted to the plate 48 may be lower than the amplitude of the force transmitted when the control action is carried out on the central contact area 58.

The force the user must exert on the upper panel 24 in order to cause the change in state of the deformable dome 40 may be greater when the user carries out the control action on the outer contact area 60 than when the user carries out the control action on the central contact area 58.

The difference in amplitude between the force to be applied to an outer contact area 60 and the force to be applied to the central contact area 58 of the switch 20 according to and embodiment may be determined depending on the radial position of each finger 56 and depending on the length of the radial portions 52.

In an embodiment, it may be possible to obtain a switch for which the amplitude of the force the user must exert on the upper panel 24 in order to cause the change in state of the deformable dome 40 is lower when the user carries out the control action on the outer contact area 60 than when the user carries out the control action on the central contact area 58.

However, the difference in values between the force to be applied to an outer contact area 60 and the force to be applied to the central contact area 58 of the switch 20 according to an embodiment is less than the difference in values between the force to be applied to an outer contact area 60 and the force to be applied to the central contact area 58 for a switch. That may enable the user to hardly be disturbed in using the device equipped with the switch 20 according to an embodiment.

It may be possible to divide the upper face of the upper panel to form contact areas 58, 60, in the manner of a telephone keypad, including, but not limited to, nine contact areas 58, 60 when the shape of the switch 20 is square, as represented in FIG. 1, or indeed, when the main shape of the switch 20 is circular, the upper face 24*s* of the upper panel 24 includes, but is not limited to, twelve outer contact areas 60 distributed around the central contact area 58 to form a numerical dial.

The switch may include a number of switching elements 28 defined depending on the number of contact areas 58, 60, for example, but not limited to, that described in the document filed under Application FR 06/51319.

In addition, due to the lever arm function of each radial portion 52 and the position of the point of contact of each finger 56 on the radial portion, the amplitude of the downward vertical movement of the upper panel 24 relative to the frame 22 may be reduced relative to a switch.

In an embodiment, it is possible to produce a switch of reduced vertical size, which may be advantageous for its incorporation in a small-sized electronic device.

What is claimed is:

1. An electrical switch with multiple switching channels comprises:

a support frame;

a panel which is mounted in a mobile manner relative to the frame and which comprises a face with which a pointing element is configured to come into contact;

an element which determines a point of contact of the pointing element on the face of the panel, comprising a plurality of electrical switching elements, each of which is associated with a switching channel, which are configured to change state selectively, depending on a position of the point of contact, when the pointing element comes into contact with the face of the panel;

a detection element which detects at least one control action which is configured to establish an associated switching channel when a pressing force with a value greater than or equal to a threshold value is exerted on the face of the panel by the pointing element, the switching channel being independent of the position of the point of contact with the face of the panel; and an intermediate plate that is arranged between the panel and the frame, and on which the panel acts in order to cause a change in state of the switching elements, wherein the intermediate plate is configured to cause the change in state of switching elements and is configured to act on the detection element under the at least one control action of the panel, and in that the intermediate plate can be at least in part deformed in order to actuate the detection element of the at least one control action after changing the state of the switching elements, wherein the detection element is arranged at a center of the panel and the switching elements are distributed around the detection element, and in that the intermediate plate comprises a central portion for actuating the detection element and comprises radial portions extending radially outwards from the central portion, wherein an outer radial end of each radial portion is configured to cause a change in state of the switching element which is associated with the radial portion, and wherein the central portion of the intermediate plate comprises a pusher made of an elastically deformable material, which is connected to inner ends of the radial portions.

2. The switch of claim 1 wherein the intermediate plate is configured to deform such that each radial portion is configured to rock entirely about its inner radial end connecting it with the central portion of the intermediate plate in order to change a state of the associated switching element and such that each radial portion is configured to rock about its outer radial end to actuate the detection element.

3. The switch of claim 1 wherein the outer radial end of each radial portion comprises a boss which projects relative to the radial portion, and which is configured to cooperate with the associated switching element.

4. The switch of claim 3 wherein the boss is configured to press on the frame such that the radial portion rocks about the boss to actuate the detection element.

5. The switch of claim 1 wherein the panel comprises a plurality of lower fingers, each of which is associated with a radial portion of the intermediate plate, which extends from an opposite face of the panel, with a free end of the finger being configured to press on the associated radial portion.

6. The switch of claim 5 wherein each lower finger is positioned radially such that it presses on the associated radial portion at a point of contact situated radially between the outer radial end and an inner radial end of a connection.

7. The switch of claim 1 wherein the intermediate plate is made in one piece by cutting and bending an elastically deformable metal plate.

8. The switch of claim 1 wherein the detection element comprises a single element forming a releasable stop for the central portion of the intermediate plate and which is configured to change state when the at least one control action is carried out on the panel.

9. The switch of claim 1, further comprising an elastic element for returning the panel to a high rest position.

10. The switch of claim 1 wherein:

each switching element comprises two electrical contacts which are carried by the frame and which are configured to be electrically connected by an associated metal tongue under the at least one control action of the panel, and the metal tongue is elastically deformable in order to connect the electrical contacts.

11. The switch of claim 10 wherein each metal tongue is part of a single metal piece comprising a central ring connected to an electrical contact common to all the switching elements.

12. The switch of claim 10 wherein the outer radial end of each radial portion of the intermediate plate is configured to press on an associated tongue in order to actuate the switching element.

13. The switch of claim 11, further comprising an intermediate protection film arranged between the intermediate plate and the metal piece.

14. An electrical switch with multiple switching channels comprises:

a support frame;

a panel which is mounted in a mobile manner relative to the frame and which comprises a face with which a pointing element is configured to come into contact;

an element which determines a point of contact of the pointing element on the face of the panel, comprising a plurality of electrical switching elements, each of which is associated with a switching channel, which are configured to change state selectively, depending on a position of the point of contact, when the pointing element comes into contact with the face of the panel;

a detection element which detects at least one control action which is configured to establish an associated switching channel when a pressing force with a value greater than or equal to a threshold value is exerted on the face of the panel by the pointing element, the switching channel being independent of the position of the point of contact with the face of the panel, and wherein the detection element which detects the at least one control action is arranged at a center of the panel and the switching elements are distributed around the detection element; and an intermediate plate that is arranged between the panel and the frame, and on which the panel acts in order to cause a change in state of the switching elements, wherein the intermediate plate is configured to cause the change in state of switching elements and is configured to act on the detection element under the at least one control action of the panel, and in that the intermediate plate can be at least in part deformed in order to actuate the detection element of the at least one control action after changing the state of the switching elements, wherein the intermediate plate comprises a central portion for actuating the detection element and radial portions extending radially outwards from the central portion wherein an outer radial end of each radial portion is configured to cause a change in state of the switching element which is associated with the radial portion, wherein the intermediate plate is configured to deform such that each radial portion is configured to rock entirely about its inner radial end connecting it with the central portion of the intermediate plate in order to change a state of the associated switching element and such that each radial portion is configured to rock about its outer radial end to actuate the detection element, and wherein the outer radial end of each radial portion comprises a boss which projects relative to the radial portion, and which is configured to cooperate with the associated switching element, and wherein the central portion of the intermediate plate comprises a pusher made of an elastically deformable material, which is connected to inner ends of the radial portions.

15. An electrical switch with multiple switching channels comprises:

a support frame;

a panel which is mounted in a mobile manner relative to the frame and which comprises a face with which a pointing element is configured to come into contact, wherein the panel comprises a plurality of lower fingers, each of which is associated with a radial portion of the intermediate plate, which extends from an opposite face of the panel, with a free end of the finger being configured to press on the associated radial portion;

an element which determines a point of contact of the pointing element on the face of the panel, comprising a plurality of electrical switching elements, each of which is associated with a switching channel, which are configured to change state selectively, depending on a position of the point of contact, when the pointing element comes into contact with the face of the panel;

a detection element which detects at least one control action which is configured to establish an associated switching channel when a pressing force with a value greater than or equal to a threshold value is exerted on the face of the panel by the pointing element, the switching channel being independent of the position of the point of contact with the face of the panel, and wherein the detection element which detects the at least one control action is arranged at a center of the panel and the switching elements are distributed around the detection element; and the intermediate plate that is arranged between the panel and the frame, and on which the panel acts in order to cause a change in state of the switching elements, wherein the intermediate plate is configured to cause the change in state of switching elements and is configured to act on the detection element under the at least one control action of the panel, and in that the intermediate plate can be at least in part deformed in order to actuate the detection element of the at least one control action after changing the state of the switching elements, wherein the intermediate plate comprises a central portion for actuating the detection element, and radial portions extending radially outwards from the central portion, wherein an outer radial end of each radial portion is configured to cause a change in state of the switching element which is associated with the radial portion, wherein the intermediate plate is configured to deform such that each radial portion is configured to rock entirely about its inner radial end connecting it with the central portion of the intermediate plate in order to change a state of the associated switching element and such that each radial portion is configured to rock about its outer radial end to actuate the detection element, and wherein the central portion of the intermediate plate comprises a pusher made of an elastically deformable material, which is connected to inner ends of the radial portions.

* * * * *